United States Patent [19]

Atkinson

[11] 4,041,549

[45] Aug. 16, 1977

[54] POCKETED GARMENT

[76] Inventor: Paul Ray Atkinson, 1624-A Hayden, Amarillo, Tex. 79102

[21] Appl. No.: 688,790

[22] Filed: May 21, 1976

[51] Int. Cl.[2] ..... A41D 1/04

[52] U.S. Cl. ..... 2/94; 24/204

[58] Field of Search ..... 24/204, DIG. 18; 2/247, 2/94

[56] References Cited

U.S. PATENT DOCUMENTS

| | | | |
|---|---|---|---|
| 2,448,416 | 8/1948 | Carter | 2/247 |
| 3,611,444 | 10/1971 | Rector | 2/247 |
| 3,748,701 | 7/1973 | DeMestral | 24/204 |
| 3,778,870 | 12/1973 | Bennett | 24/204 |

*Primary Examiner*—Werner H. Schroeder
*Assistant Examiner*—Doris L. Troutman
*Attorney, Agent, or Firm*—Ely Silverman

[57] ABSTRACT

In a vest formed of flexible panels that adjust to the contour of the wearer, pocket support and shape stiffening structures are provided so that the pockets may adjustably yet firmly be located or removed and also, when in place, conform to the curved contours of the worn garment panels while providing rigidity of shape, dimension and conformance to body contour.

8 Claims, 25 Drawing Figures

FIG.20
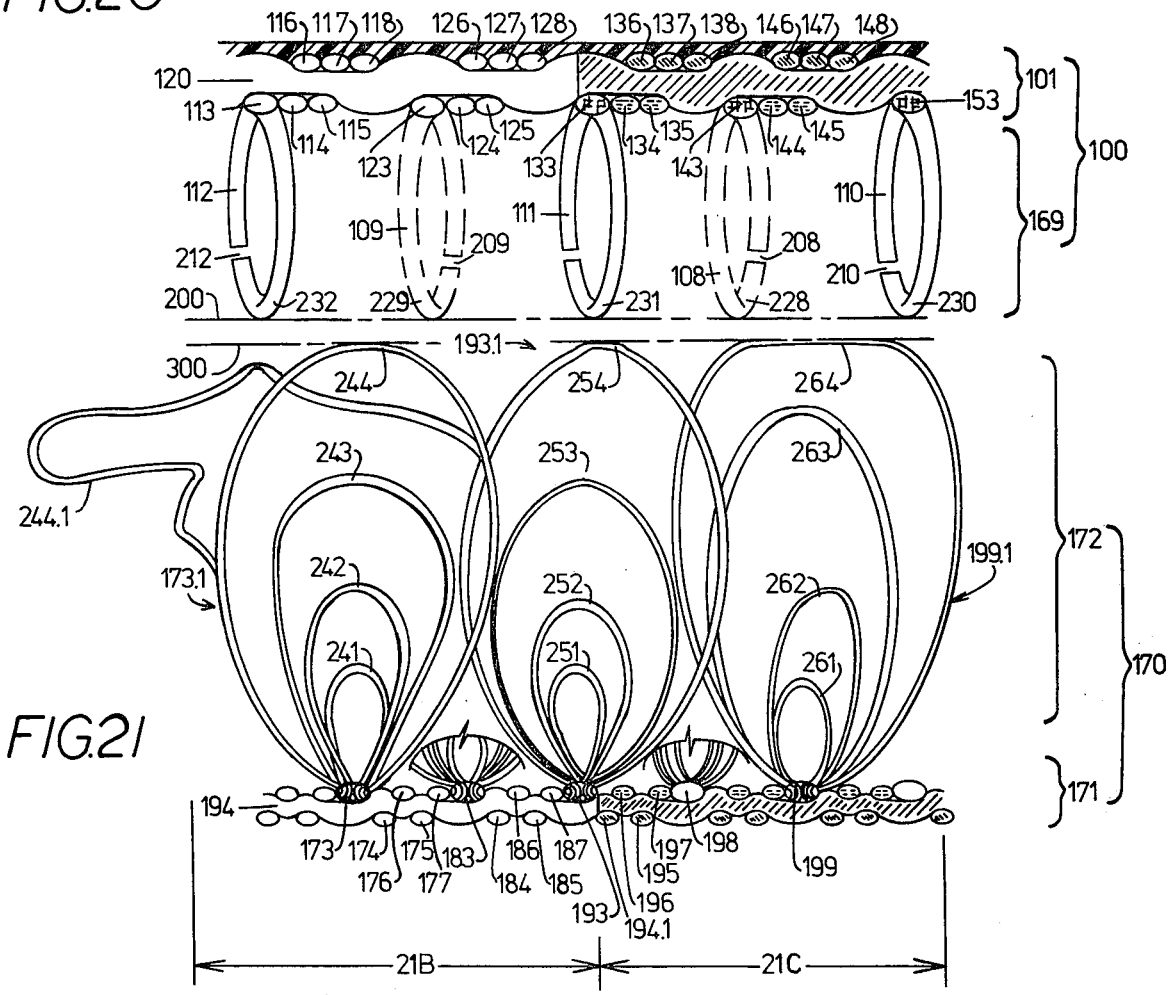
FIG.21
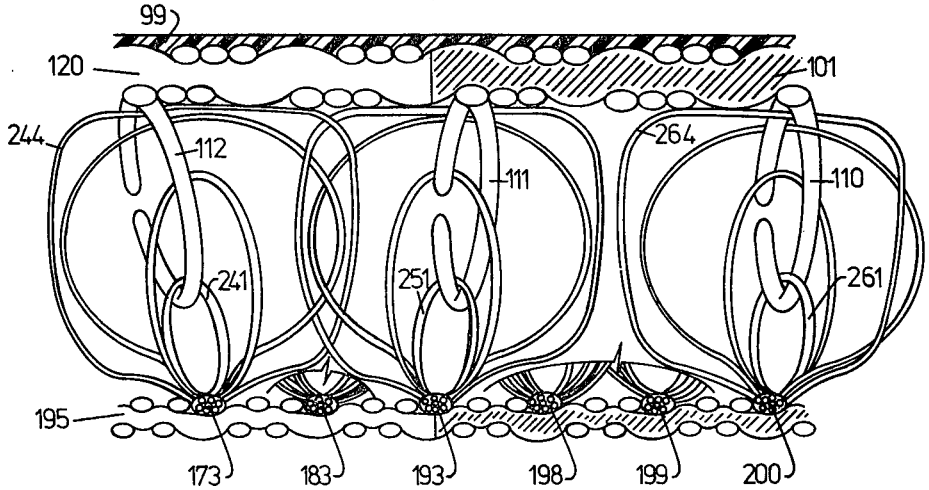
FIG.22

FIG.23
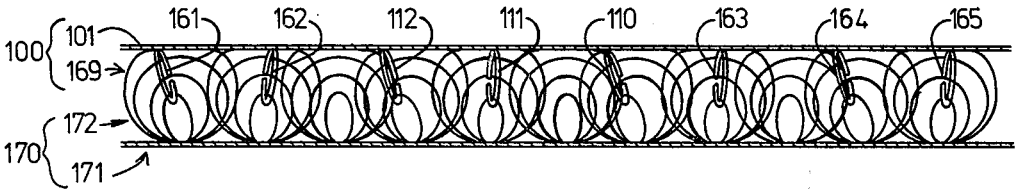
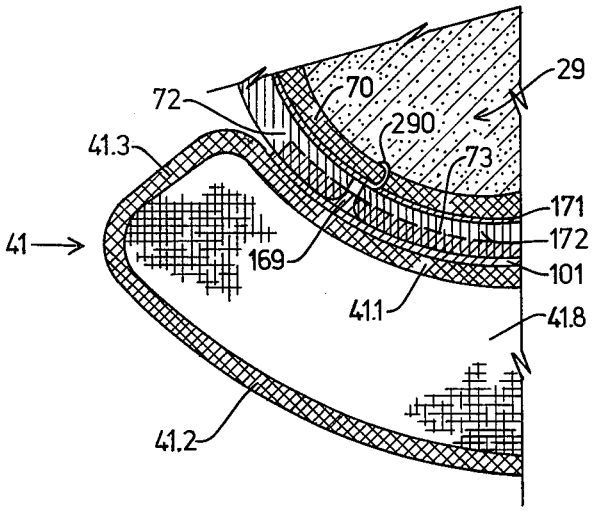
FIG.25
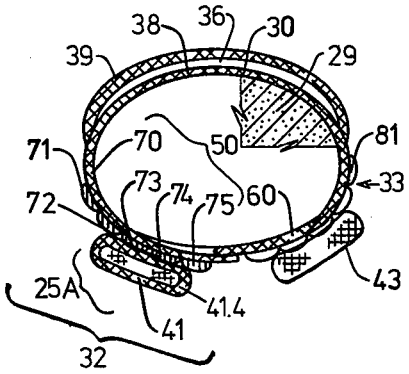
FIG.24

POCKETED GARMENT

BACKGROUND OF THE INVENTION

The field of art to which this invention pertains is body garments such as coats and more particularly vests for hunters and special article carriers.

THE PRIOR ART

The prior art of providing a plurality of pockets on vest or like body contour matching garments (e.g. U.S. Pat. Nos. 2,948,898 and 2,448,416) has not provided protuberance-free exterior surfaces and detachable exterior pockets which are also adjustable as to position so as to provide minimum interference with the wearer's action yet are comfortable to the wearer or the combination thereof.

SUMMARY OF THE INVENTION

Large surfaces free of palpable protuberances and formed of flexible multi-hooked attachment members are applied to the body facing exterior surface of each of several detachable pockets to firmly yet releasably engage with curved exterior contours of outwardly facing multi-loop bearing panels free of palpable protuberances on the exterior of body garments. The resulting firm yet releasable connection of the flexible hooked attachment members to the flexible contour fitting loop bearing exterior panels provides a composite dimensionally stable stiffening member that conforms to the contour of the garment exterior; hence, is comfortable as well as mechanically convenient to the wearer while evenly distributing the weight of the material carried in the pockets and provides for location of such comfortable carriers where most convenient to wearer's access to and use of the pocket contents as well as being readily cleaned.

Each of FIGS. 1-5 is drawn to scale for ready approximation of dimensions and operations set out in the text herebelow to the structures in such figures.

Figure 6:
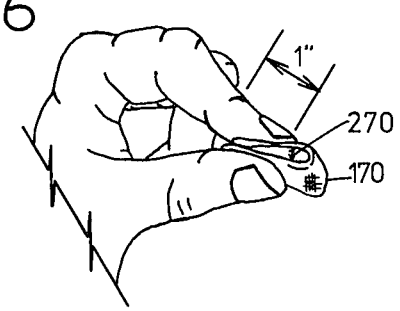
Figure 7:
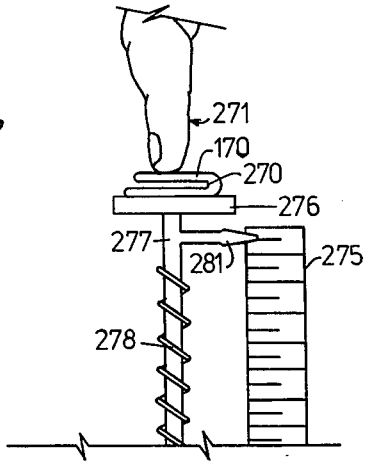

FIG. 6 is a view of a portion of a pile fabric panel held between human fingers and bent to demonstrate the flexibility thereof and FIG. 7 is a view of the same pile fabric portion held to measure its flexibility.

Figure 8:
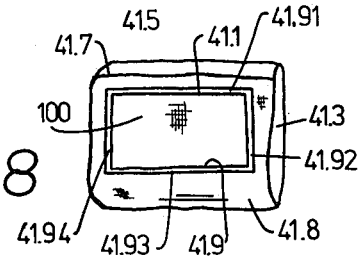

FIG. 8 is a rear view of the pocket assembly 41.

Figure 9:
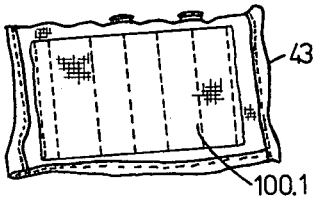

FIG. 9 is a rear view of the pocket assembly 43.

Figure 10:
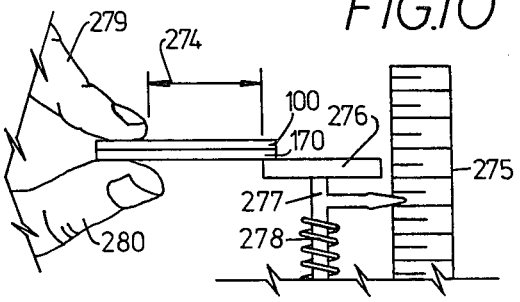

FIG. 10 is a showing of the operative combination of pile fabric and a hook fabric portion while tested to show the rigidity of the combination thereof.

Figure 11:
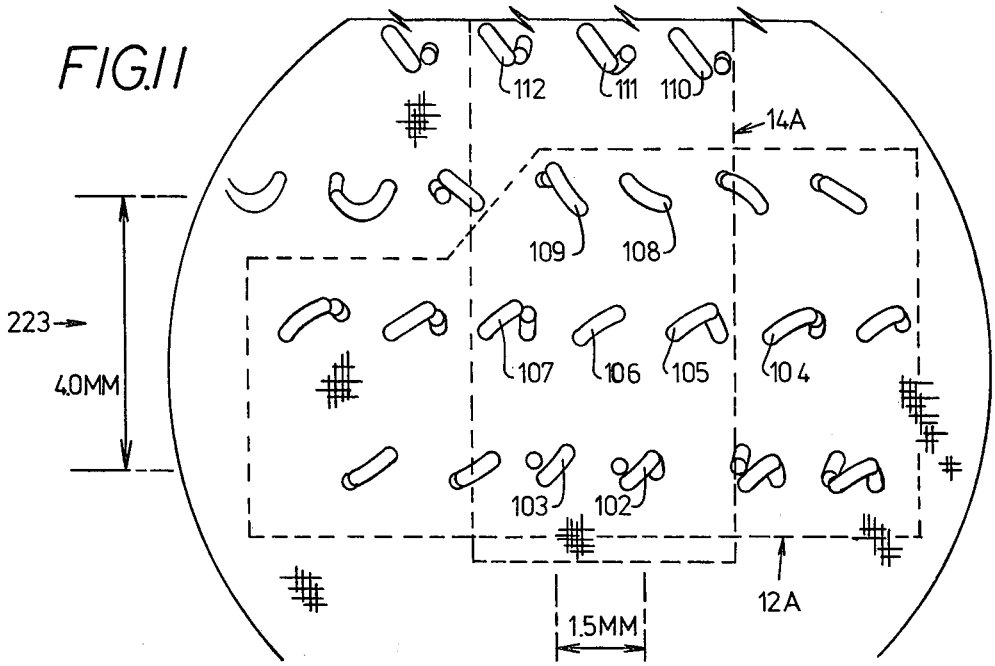

FIG. 11 is an enlarged diagrammatic plan view of a portion of the hook side of the hook panel shown to scale and to the scale of the length dimension scale 223 shown at the side thereof.

Figure 12:
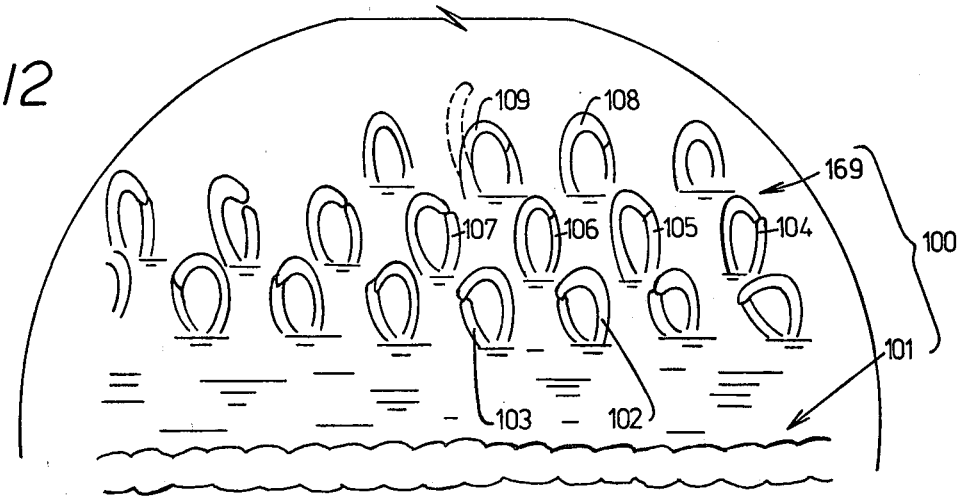

FIG. 12 is a diagrammatic top oblique view of a portion of the pile fabric 100 to diagrammatically illustrate the position of the hooks on such fabric. The portion of the fabric 100 shown in this figure is the portion shown in zone 12A of FIG. 11.

Figure 13:
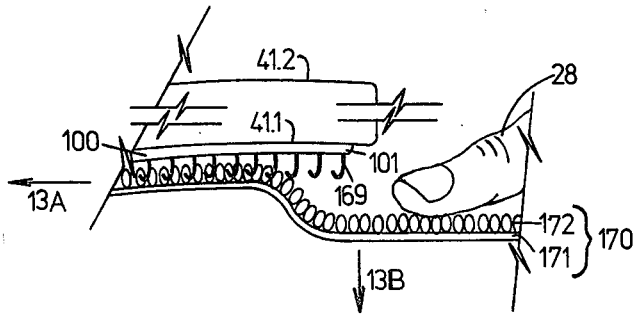

FIG. 13 is a diagrammatic showing of the separation of a hook panel 100 on a pocket assembly 41 from a portion of the pile panel 170.

Figure 14:
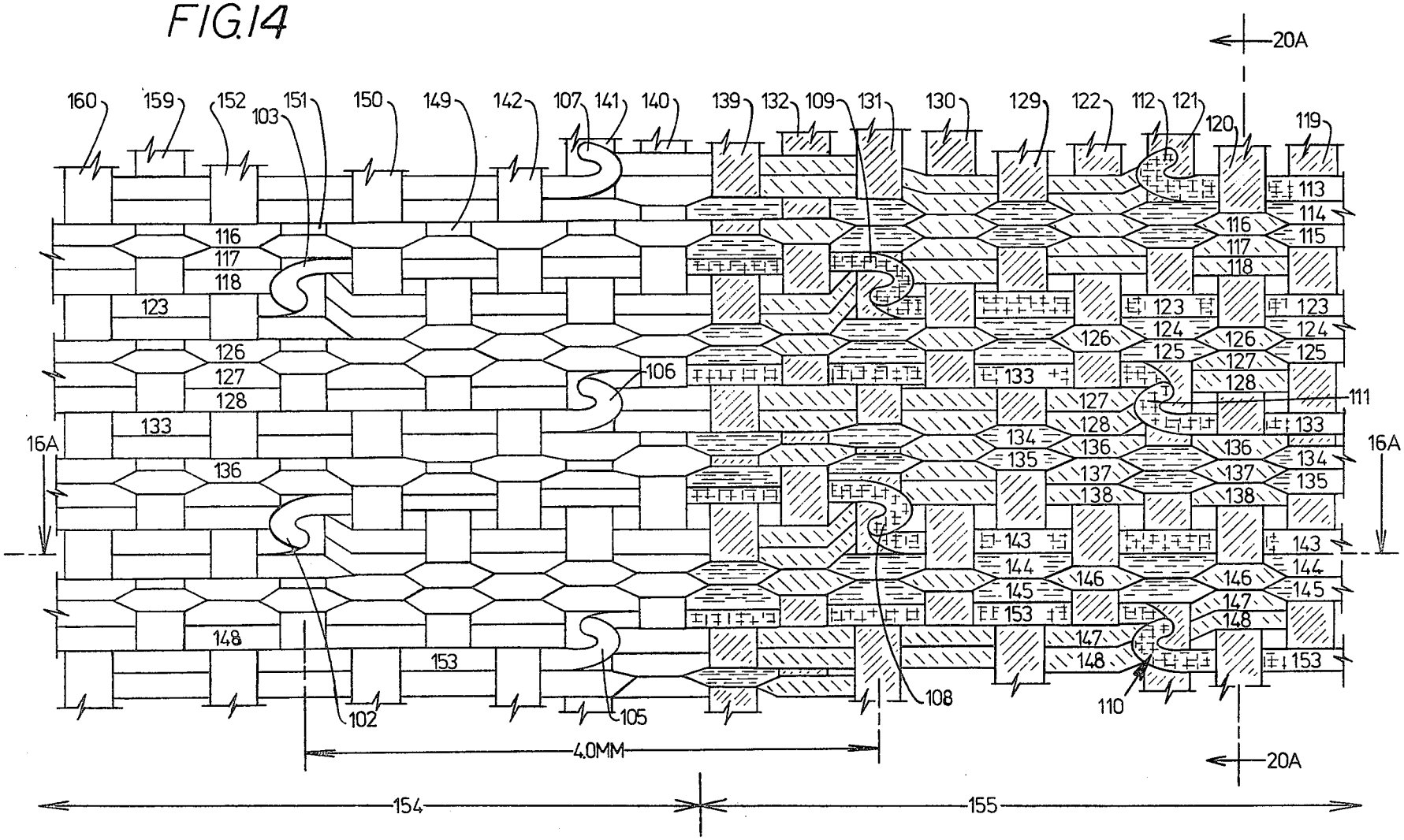

FIG. 14 is an enlarged plan view drawn to scale of the portion of the hook panel in zone 14A of FIG. 11 to shown, in quantitative detail, the relations of the interwoven fiber components and the hooks of such panel.

Figure 15:
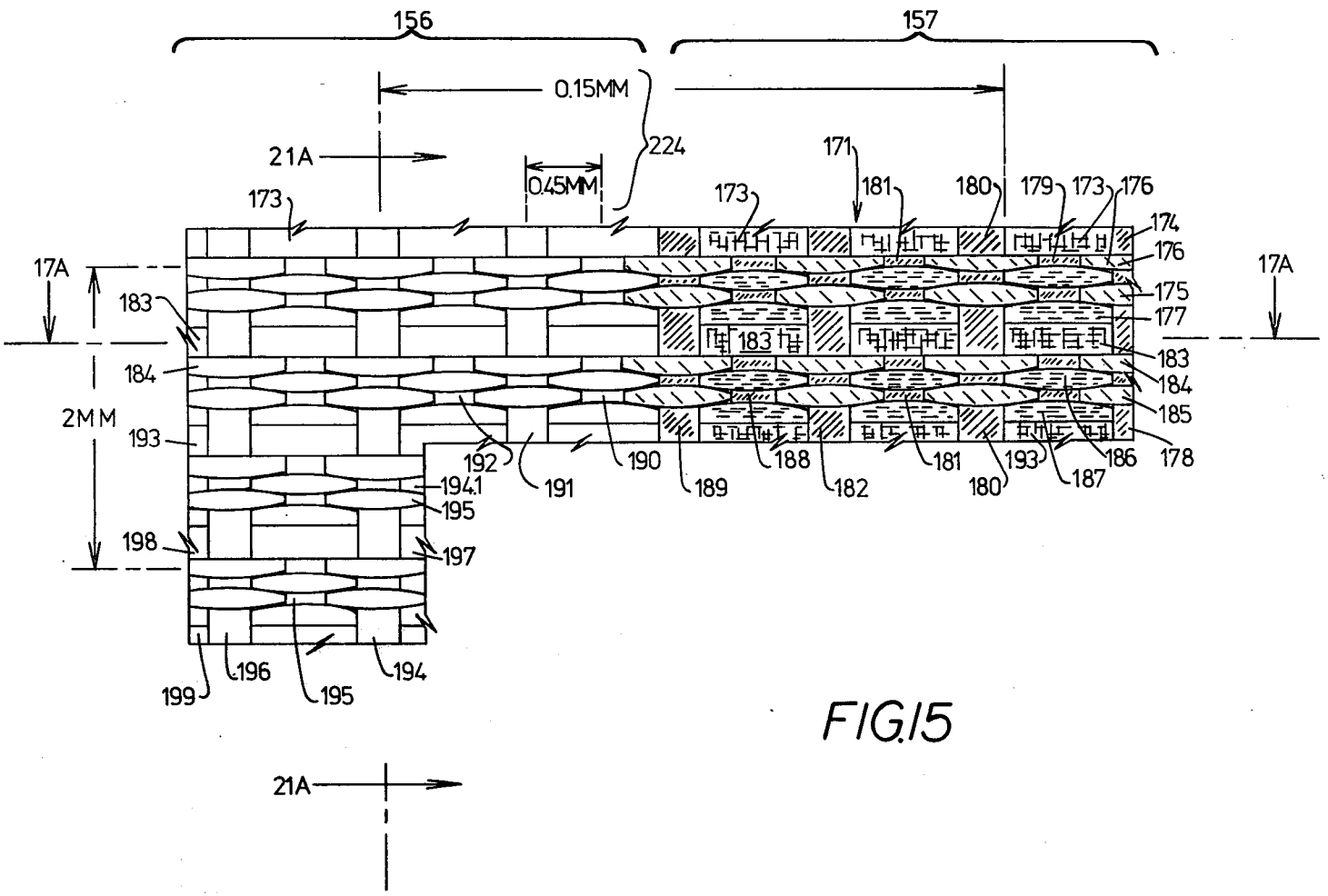

FIG. 15 is an enlarged plan view drawn to scale and drawn to the same scale as FIG. 13 of the bottom surface 171 of pile panel 170.

Figures 16, 17:
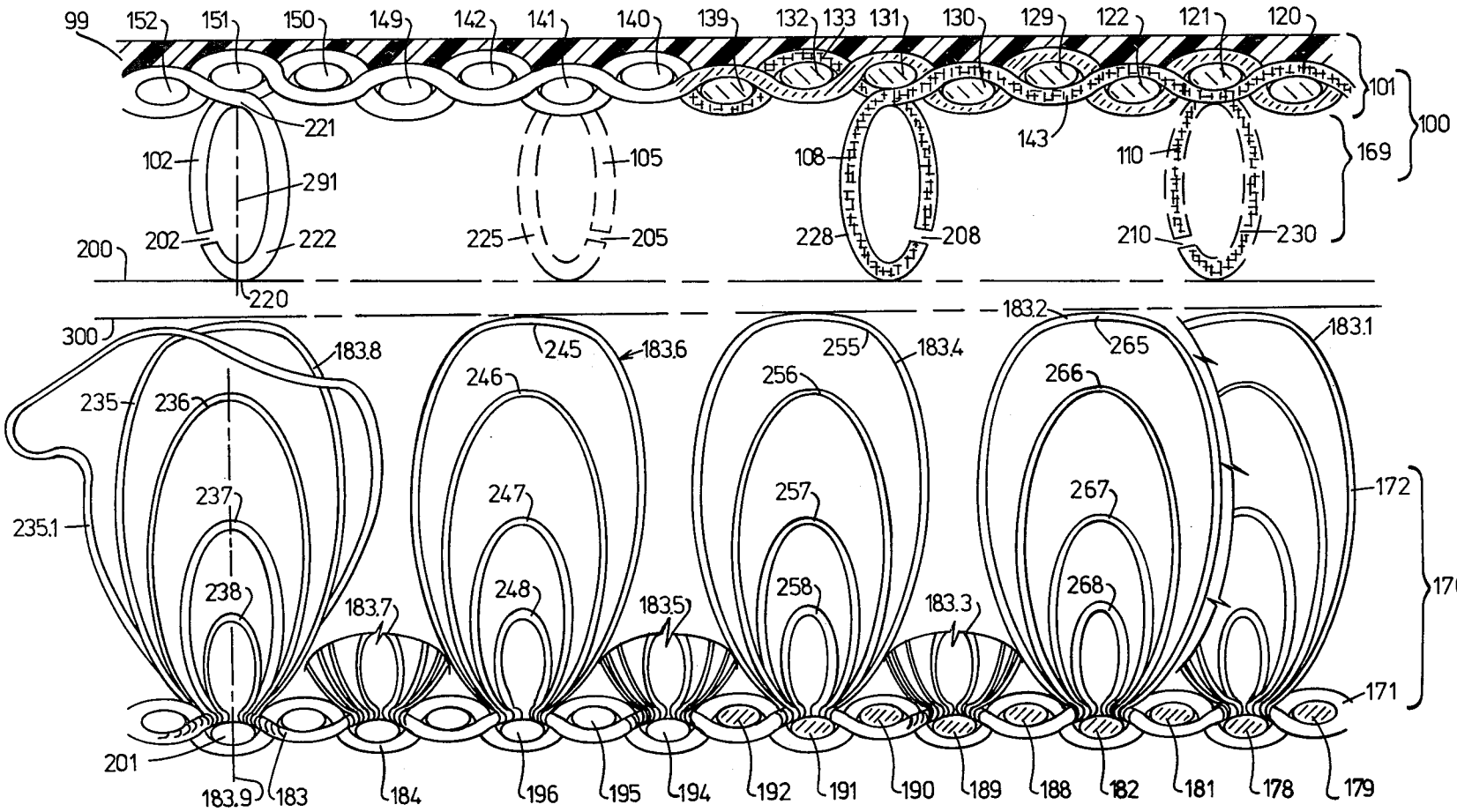

FIG. 16 is a vertical sectional view of the hook panel 100 transverse to the direction of the filling yarns 119-122, 149-152, 139-142, 129-132 of FIG. 14 through the plane 16A—16A of FIG. 14. This figure shows relationships of hooks, as 102, 106 and 108 to other components of the hook panel 100.

FIG. 17 is a vertical sectional view of the pile panel 170 through the plane indicated as 17A—17A of FIG. 15. This view is taken transverse to filling yarns, as 178-182 and 188-192, of FIG. 15 showing relationships of the pile portions and base portions of the pile fabric 170 in diagrammatic fashion.

FIGS. 14, 15, 16, 17, 18, 20, 21 and 22 are all drawn to the same scale, 224 shown in FIG. 15.

Figure 18:
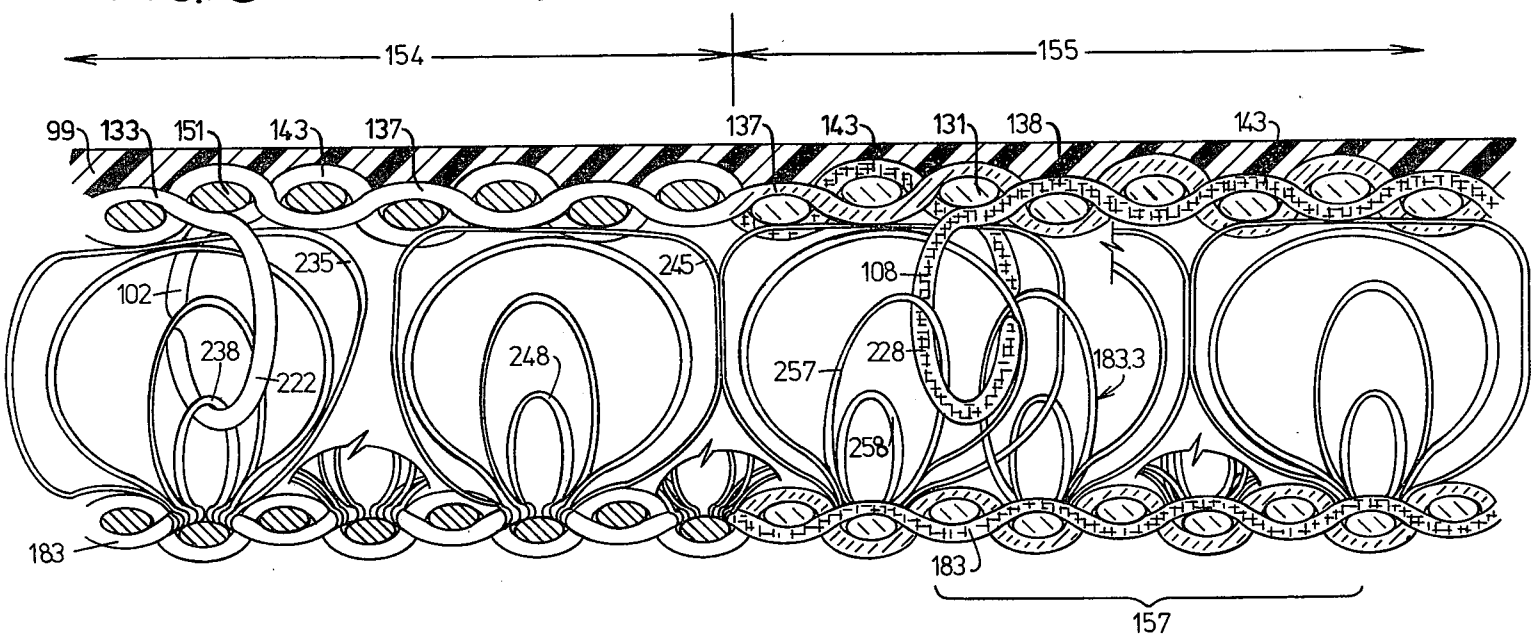

In one part (155) of FIGS. 14 and 18 each of several different yarns in each like group of yarns are shown in different color coded shading, and similar color coding of such yarns is used in FIGS. 18, 20 and 22; in one part, 157, of FIG. 15 each of several different yarn in each like group of yarns is shown in different color coded shading and similar color coding of such yarns is used in FIGS. 18, 21 and 22. The same color code shading is used throughout all such showing of such color coding for each yarn concurrent with referent numbers therefor to illustrate the serially connected portions of each of the same yarns in different portions of the fabrics shown and to distinguish such yarn from adjacent yarns of the same fabric. Portion 156 of FIG. 15 and portion 154 of FIGS. 14 and 18 are shown with conventional cross-section hatching.

Figure 1:
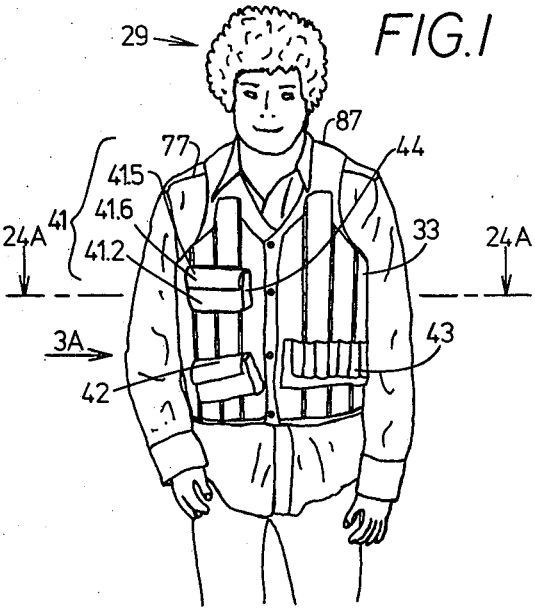
FIG. 1 is a front view of a vest according to this invention shown on a wearer thereof with one array of pockets on the vest.
Figure 2:
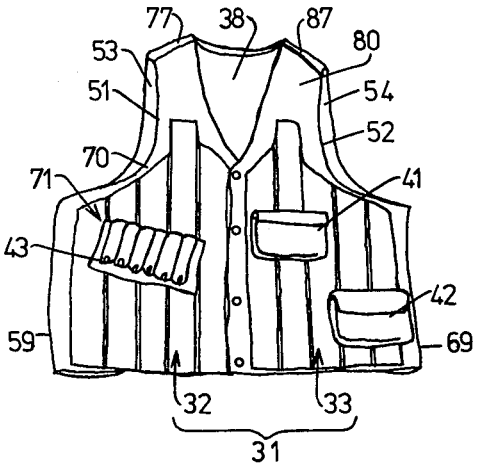
FIG. 2 is a front view of the vest with front panels joined and with another array of pockets thereon.
Figure 5:
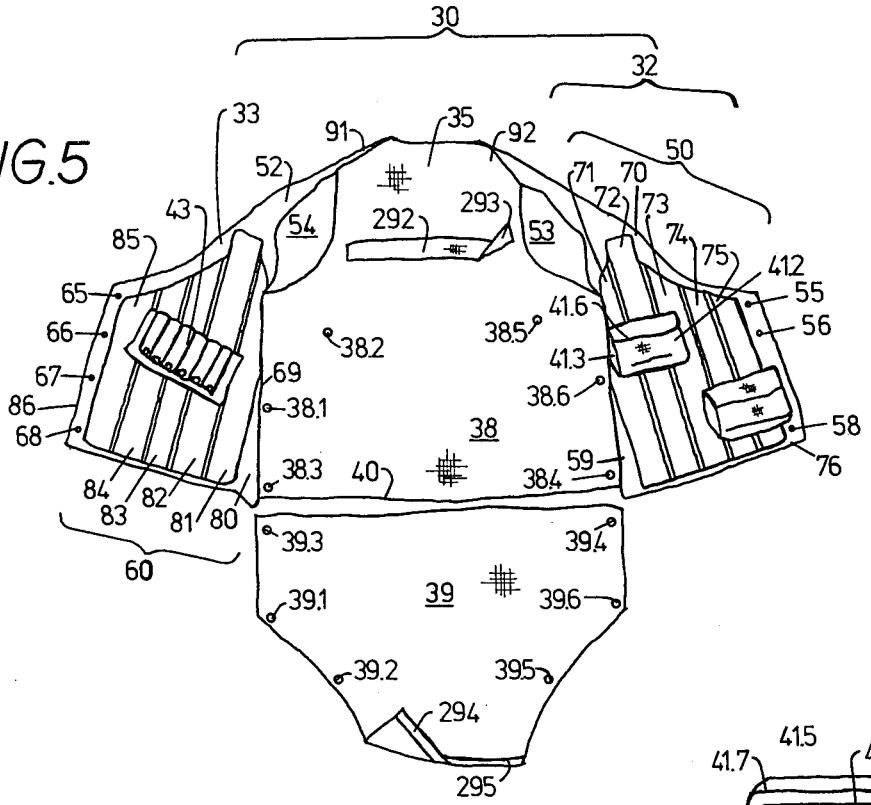
FIG. 5 is a view of the vest of FIG. 1 with its front panels folded outwards and with the back pocket rear panels opened and folded down.

FIG. 18 is a transverse vertical section through plane 16A—16A of FIG. 14 and concurrently through the plane 17A—17A of FIG. 15 when the hook panel 100 and loop panel 170 are joined together as in FIGS. 1, 2 and 5. FIG. 18 diagrammatically shows the relations of components of the loop panel and components of the hook panel and relative to each other during their operative connection to each other. The yarns in the right hand portion 155 of FIG. 18 are shown coded for color to match the color coding for such yarns shown in FIGS. 14 and 15. The left hand portion 154 of FIG. 18 is shown with conventional section lines.

Figure 19:
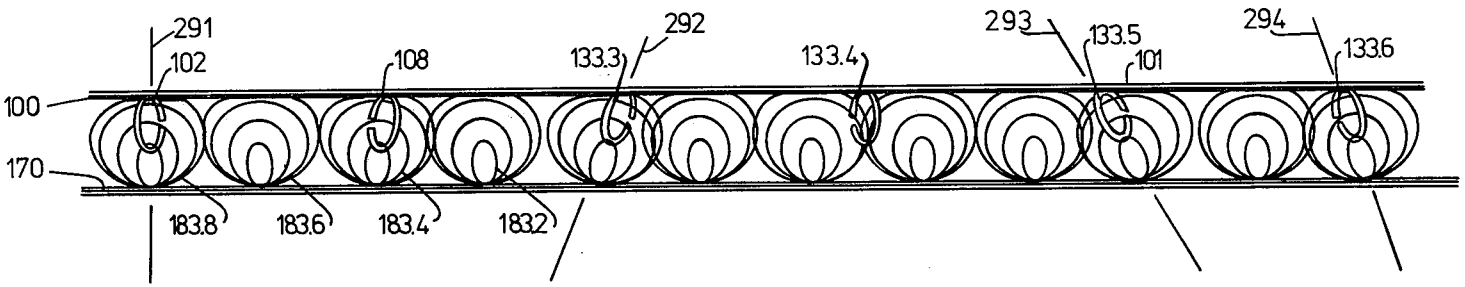

FIG. 19 is a diagrammatic sectional view as in FIG. 18 but drawn to a smaller scale than FIG. 18 to diagrammatically show the relations of the lengths of the components joining the panels 100 and 170 in their operatively joined condition as seen along the sections corresponding to plane 16A—16A of FIG. 14 and plane 17A—17A of FIG. 15; i.e. parallel to the length of the fibers, as 143, forming the hook members in panel 100 and parallel to the length of the yarns, as 183, forming the pile portions in panel 170.

In FIGS. 18 and 19 the hooks shown in dashed lines in FIG. 16 are omitted for purposes of clarity of those figures.

FIG. 20 is a longitudinal sectional view through a portion of the hook panel at the plane 20A—20A of FIG. 14: this view is taken parallel to the direction of filling yarns, as 120, and transverse to (a) the warp yarns, as 134–138, and (b) the yarns, as 133, forming hooks as 111. This view is perpendicular to the view shown in FIG. 16.

FIG. 21 is a vertical sectional view through a portion of the pile panel at the plane indicated as 21A—21A of FIG. 15. This view is taken parallel to the warp yarns, as 194 and 188–192 of FIG. 15: this view shows relations of the pile portion and the base portion of the pile fabric 170 in a section transverse to the sectional view shown in FIG. 17.

FIG. 22 is a transverse vertical section through plane 20A—20A of FIG. 14 and concurrently through the plane 21A—21A of FIG. 15 when the hook panel 100 and loop panel 170 are joined together as in FIGS. 1, 2 and 5. This FIG. 22 shows a section transverse to that shown in FIG. 18 and diagrammatically shows the relations of components of the loop panel and the components of the hook panel relative in such section during their operative connection to each other. One portion, 21C, of this figure shows the yarns coded for color to match the color coding shown in FIGS. 14 and 15 and the other portion—21B— of this figure is shown with conventional crosshatching.

FIG. 23 is shown to a smaller scale than FIG. 22 and diagrammatically shows the relations of the lengths of the components joining the panels 100 and 170 in their joined condition as in FIGS. 1, 2 and 5 as seen along the sections corresponding to plane 20A—20A of FIG. 14 and plane 21A—21A of FIG. 15: this view is at the same scale as the scale of FIG. 19 but is taken along a plane at right angles to the view shown in FIG. 19.

FIG. 24 is a diagrammatic transverse section at plane 24A—24A of FIG. 1 to illustrate the curved contour of the front portions 32 and 33 of the vest 30 and of the right front base fabric assembly 50 and the left front base fabric assembly 60 to which pockets are attached.

FIG. 25 is an enlarged portion of zone 25A of FIG. 24.

DESCRIPTION OF THE PREFERRED EMBODIMENT

The garment 30 comprises, in operative combination, a front panel and pocket assembly 31 and a rear panel and pocket assembly 35.

The front panel and pocket assembly comprises a right front panel and pocket assembly side 32 and a left front panel and pocket assembly 33.

The right front panel and pocket assembly 32 comprises a right front base fabric assembly 50, a plurality of pockets 41 and 42, and right panel closure fastener elements 55–58. The right front fabric assembly 50 comprises a sturdy yet flexible right base fabric panel 70 and a series of like adjacent horizontally narrow vertically extending straight edged pile panels 71–75, each flexibly yet firmly attached at their sides, top and bottom edges to the panel 70 as by strong threads. The members 65–68 are conventional releasable snap fasteners ball, tongued or male elements and are firmly and permanently joined to the panel 70 near to the central edge 76 of panel 70.

The left front panel and pocket assembly 33 comprises a left front base fabric assembly 60 and a pocket 43 and closure fastener elements 65–68. The left front base fabric assembly 60 comprises a sturdy yet flexible left base fabric panel 80 and a series of like adjacent horizontally narrow vertically extending straight edges adjacent pile panels 81–85 each flexibly yet firmly attached at their sides and top and bottom edges to the panel 80 as by strong threads. The fastener elements 65–68 are conventional releasable snap fastener socket, ring or female grommet-like elements and are firmly and permanently joined to the panel 60 near to central edge 86 of that panel. The central edge 86 of the left front base panel is thereby provided with a series of snap fastener members 65–68 that match with and releasably engages the snap fastener members 55–58 respectively in the closed position thereof.

Figure 3:
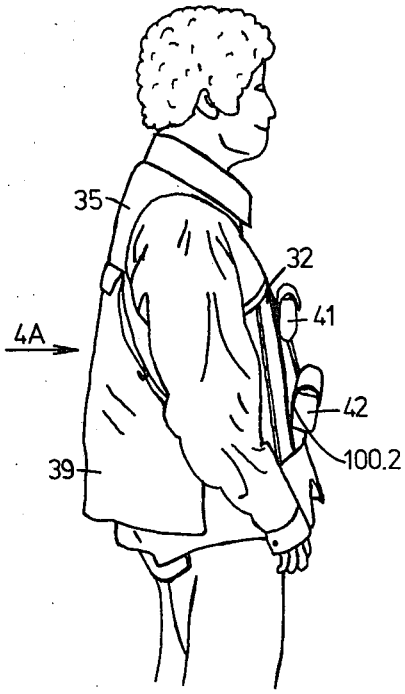
FIG. 3 is a side view of the wearer with vest of FIG. 1 as seen along the direction of the arrow 3A in FIG. 1.
Figure 4:
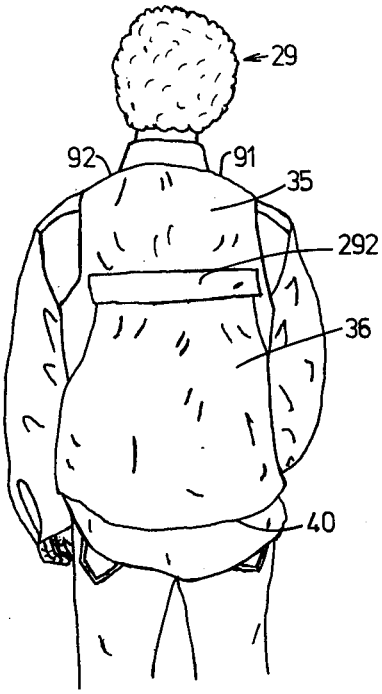
FIG. 4 is a rear view of the wearer and vest of FIGS. 1 and 3 as seen along the direction of the arrow 4A of FIG. 3.

The rear panel assembly 35 comprises an upper inner rear fabric panel 38 and an outer rear panel 39 firmly yet flexibly joined at their bottom edge 40. Snap fastener elements 38.1–38.6 on the inner panel 38 and snap fastener elements 39.1–39.6 on panel 39 are releasably joined to form a game bag 36 in the joined position of those fasteners as shown in FIGS. 3 and 4. The left lateral edge 69 of the left front fabric panel 80 and the right lateral edge of the inner panel 38 is joined to the lateral edges 69 and 59 of the front base fabric panels 80 and 70 respectively.

The base panel 70 of the front right panel assembly 32 has, attached thereto a parallel series of vertically extending pile fabric strips 71, 72, 73 and 74 and 75 while the left panel assembly 33 has a similar series of vertically extending pile fabric strips 81, 82, 83, 84 and 85. The pile fabric strip 71 is at the right most portion of the right base panel and the pile fabric strip 75 is closest to the closure edge 76 adjacent to which a plurality of closure fastener elements 55–58 are located. The pile fabric strip 81 is at the left most portion of the left base panel 80 and the pile fabric strip 85 is closest to the closure edge 86 adjacent to which the plurality of closure fastener elements 65–68 are located.

The top edge 77 of the right base panel 70 and the top edge 87 of the left armhole edge 51 and left armhole edge 52, respectively (in turn adjacent to left and right armholes 53 and 54, respectively) and firmly attached to the upper right edge 91 and upper left edge 92 of the back panel 35.

The pocket 41 comprises a rear wall 41.1, a front wall 41.2, a right side wall 41.3, a left side wall 41.4, a bottom wall 41.8 and a top cover panel 41.5 with a forward downwardly extending lip 41.6, each formed of a strong woven fabric and all firmly joined together.

The rear of the top panel is flexibly joined at its rear edge 41.7 to the top of the rear panel. A long and wide hook panel 100 is firmly attached to the rear wall 41.1 and serves to firmly and adjustably and synergistically and releasably attach the pocket 41 to the pile strips on the front panel assembly 32. The pockets 42 and 43 are similarly composed of rear, side, bottom, top and front and bottom walls and are provided with long and wide hook panels as 100.2 and 100.1 each similar in structure to panel 100 and similarly adjustably, firmly, synergistically and releasably attach the pockets as 42 and 43 to pile panels as 71-75 and 81-85 on the front of the vest assembly. The structure and relations of hook panel 100 to the pile panel to which attached are the same as the structure and relations holding the hook panels 100.1 and 100.2 to adjacent portions of the pile panels of the vest assembly; accordingly the following description of the panel 100 applies also to the other hook panels as 100.1 and 100.2.

A hook panel 100 is firmly attached to the rear panel 41.1. The hook panel 100 is composed of a plurality of like sets of yarns or fibers, each of such sets of yarns or fibers being composed of a plurality of flexible multifilament filling and warp fibers and a relatively firm monofilament, all of said sets of yarn held in a flexible plastic layer 99 adherent to the fibers: these fibers are arranged in a base layer 101 with a plurality of like shaped and like rigid hook members firmly attached to and projecting from the base layer in a regular pattern of spacing and orientation as shown in FIGS. 11, 12, 14, 16, 18, 19, 20, 22 and 23.

The hook panel 100 is thus formed of a flexible composite woven and plastic base layer 101 and a plurality of hooks, as 102–112 attached thereto. The base layer 101 is formed of a plurality of parallel multifilament warp yarns, as 119–123; 129–132; 139–142; 149–152; 159 and 160 and a resilient and yet dimensionally stable momofilament fibers as 113, 123, 133, 143 and 153 interwoven with parallel filler yarns, as 114–118; 124–128; 134–138 and 144–148 as shown in FIGS. 14, 16, 18, 20 and 22.

Each of the rigid monofilament yarns or fibers as 143 is formed into regularly spaced loops as 222 and 228 (see FIG. 16) [and loop 232 for fiber 113, loop 231 for fiber 133, loop 229 for fiber 109, loop 225 and 230 for fiber 153 as shown in FIG. 20] at regular distances along the length of such fibers. The fibers and loops and resulting hooks are also regularly spaced from each other transversely to the length of such fibers as shown for hooks 102–112 in FIGS. 11, 14, 16 and 20. Each of such hooks is formed from a loop as 222, 225, 228–232; each of the loops as 222, 225, 228–232 is cut at a gap, 202, 205 and 208–212, respectively for each of such loops, and forms a J-shaped hook as 102, 105 and 108–112 respectively as shown in FIGS. 16 and 20 with which to firmly yet releasably engage loop-like members as 238, 248, 258, 268 (and 241, 251 and 261) which form part of the pile panels as 71–75 and 81–85.

Each of the loops is cut at a gap which, as shown in FIG. 16 at a point intermediate between top or curved tip 220 of the loop 222 and the base, 221 of that loop adjacent the warp yarn 151. Accordingly the group of hooks as 102–112 as shown in FIGS. 11 and 12 forms an outer structure that is smooth to the human touch as along the plane 200 in which the outer tips as 220 of each of the hooks as 102, 105, 100, 110 lie.

Each of the pile fabric strips, as 71–75 and 81–85 is composed of a continuous series of like pile panel portions as 170.

Each pile panel portion as 170 comprises a flexible composite woven layer 171 with a plurality of projecting loop assemblies forming a pile layer 172. The base layer 171 is formed of a plurality of parallel multifilament warp yarns interwoven with parallel filler yarns as a plurality of like sets of interwoven yarns or fibers as shown in FIGS. 15, 17 and 21; e.g. a first set of filling yarns 173–177 and another set of adjacent filling yarns 183–187, and neighboring sets of warp yarns (the warp yarns separated by the filling yarns) 178–182, 188–192 and 194, 195 and 196. Each of such sets of yarns or fibers in turn is composed of a plurality of flexible multifilament fibers.

The filling and warp yarns are arranged in a 2 × 1 construction; i.e. an oxford weave with multifilament loop-forming yarns as 173, 183 and 193 supported by and interwoven with base forming yarns as 174–177 and 184–187 and the warp yarns of such fabric.

Each of the multifilament filling fibers, as 183, 173, 193 form, as shown for fiber 183 in FIG. 17, a series of loop assemblies 183.1–183.8 along its length. The loop assemblies form an outer surface 300 that is soft and smooth to the human touch although the outermost loops vary in size and shape. However, all loops of the loop assemblies are formed with the same diameter fibers and have the same surface texture to human touch although clearly shown at 5X magnification to be formed of a mat of curved looped fibers with a substantially flat outer surface (300).

In FIG. 17 only loop assemblies 183.1, 183.2, 183.4, 183.6 and 183.8 are shown for clarity. The showings of FIGS. 17, 18, 21 and 22 are diagrammatic inasmuch as the same fiber 183, as shown in FIGS. 18 and 21 provide groups of such loops which extend in all directions about a central loop axis as 183.9 transverse to the fiber 183 in the center of each loop group as 183.8, as shown in FIG. 17.

Accordingly, the loop assemblies 183.1–183.8 as well as 173.1, 193.1 and 199.1 (as shown in FIG. 21) also provide a plurality of like shape and size loop assemblies, each firmly attached to and projecting from the pile panel base layer 170 in a regular pattern of spacing and orientation as shown in FIGS. 17, 18, 21 and 22. The back of pile layer 170 is shown in FIG. 15.

Each of the multifilament loop forming yarns, as 183 forms a plurality of loop assemlies, as 183.1–183.8 and each of these loop assemblies as 183.8 is formed of a plurality of different sized loops as 235–238 which extend parallel to the length of the fiber as 183 and perpendicular to plane of layer 171; also, as shown for loop assemblies 173.1, 193.1 and 199.1 in FIG. 21 each of the loop assemblies of the pile layer 171 also have loop components as 241–244 which extend in planes transverse to the length of the multifilament fibers as 173, 193 and 199, respectively (as well as 183 and 198) such loops aside from differing directions of such loops in the loop assemblies.

Each of the loop subassemblies as 183.8 in turn comprises a plurality of different size loops as 235, 236, 237 and 238 (see FIG. 17). Loop assemblies as 183.6 are formed of similarly sized and arrayed loops 245–248, loop assembly 183.4 is formed of corresponding loops 255, 258 and loop assembly 183.2 is formed of corresponding loops 265–268.

Additional to (a) these firm groups of loops as 183.1–183.8 (and 173.1, 194.1 and 199.1) each of which is formed of loops as 235–238 (and 241–244 respectively) which are shaped free of re-entrant angles and quite resiliently yet firmly resistent to compression as well as deformation and are generally co-axial, as about axis 183.9, the layer 172 also includes (b) some additional loose convuluted peripheral loops as 235.1 and 244.1 shaped with re-entrant angle located peripherally to the interior loops (as 233, 238, 241 and 242); such convuluted loops are readily deformable and have no substantial resistance to compression or deformation although such convuluted fibers do return to their original shape when deforming stress is removed therefrom. Accordingly the pile layer 169 forms an outer soft surface 300 that is uniform to human touch and free of palpable protuberances; i.e. without protuberances that either (a) catch on like pieces of cloth or (b) inhibit motion of a human hand thereacross or (c) provide surface protuberance which can be seized upon by human fingers (although the pile fabric can be engaged by human fingernails).

The distance from the centerline of one monofilament hook-forming fiber or yarn as 123 to the centerline of a neighboring monofilament hook-forming fiber or yarn as 133 at position of yarns 120 and 159 in direction transverse to the length of such fibers, e.g. parallel to warp yarns 160 and 152, is 0.75 mm., when the layer 169 is flat as shown in FIG. 14.

The distance between parallel yarns as 123 and 143 is 1.5 mm. as measured along any of the warp yarns of FIG. 15.

In the position of yarns shown in FIG. 14 the distance between the center lines of warp yarns as 151 and 131 is 4.0 mm. (131 is the 8th yarn removed from 151) measured parallel to the filling yarns 135 and 145 therebetween. This is the same distance as the distance between hooks 103 and 109.

The warp yarns 119–122, 129–122, 139–142, 149–152 are each 0.4 mm. in maximum diameter; the hook-forming monofilament yarns as 113, 123, 133, 143 and 153 are each 0.3 mm. maximum diameter and the filling yarns as 114–117, 124–127, 134–137, 144–147 are each 0.2 mm. maximum diameter.

The distance from centerline of warp yarn 194 to the right hand edge (as shown in FIG. 15) of warp yarn 180 is 0.15 inch. The distance from centerline of warp yarn 194 to centerline of warp yarn 178 is 4.5 mm.

In the position of yarn component shown in FIG. 15 the centerline to centerline distance between parallel yet spaced apart multifilament loop-forming yarns as 173 and 198 is 2.0 mm. (0.67 mm. between adjacent loop-forming yarns) and the centerline to centerline distance between parallel adjacent warp yarns as 190 and 191 is 0.45 mm. The maximum diameter of non-loop-forming filling yarns as 184 and 185 is 0.2 mm. The maximum diameter of loop-forming filling yarns as 183 is 0.3 mm. There are usually 7 loop-forming fibers as 245–248 (and others extending transverse thereto and parallel to loops as 241–244 of FIG. 21) in each multifilament yarn as 183.

The edge portions of each of the pile panels, 71–75 and 81–85, are firmly yet flexibly joined to the fabric panels 70 and 80 respectively by close and complete and uniformly spaced and sturdy straight stitching as 290 along the length of such edges between panel 70 and each of panels 71–75. Panel 70 is made of a compact close woven 1 × 1 weave 26 × 26 cloth count flexible yet sturdy balanced cotton canvas cloth.

The edge portions 41.91, 41.92, 41.93 and 41.94 of each of the hook panel portions, as 100, is firmly yet flexibly joined to the fabric forming a rear pocket wall, as 41.1 by close and uniform and sturdy straight stitching 41.9 along the full length of each of such edges. Pockets 41–43 are also formed of sturdy closely woven flexible cotton canvas fabric as 70.

Each of the loop strips, as 71–75 (and 81–85) is firmly yet flexibly fixed to the right base panel 70 (and 80 respectively) by stitching more closely spaced than the edges of each such panel with a maximum distance of 1½ inch (3.7cm) between such lines of stitching so that each such panel will firmly and closely fit the curved contour of the panel 70 which matches the adjacent external contour of the body of the wearer 29.

Each of the hook panel base layer portions, as 101, is firmly held to the panel 70 by continuous evenly spaced stitching as 290 along all of the edge portions of such panels as 100 on pocket 41 (and like panels as 100.1 on pocket 43) and, also by stitching with a maximum spacing of 1 inch between parallel lines of stitching, some of which will be on such edges.

Each portion of the pile fabric layer as 171 is held to the hook fabric layer 169 by the mechanical interconnection of the loop components of loop layer 172 of the pile panel 170 and the hook components of hook layer 169 of the hook panel 100.

In operation the smaller, as 257 of group 183.4 and of group 183.3 and the smallest of the loops, as 238 in FIG. 18 and loops 241, 251 and 261 as shown in FIG. 22 serve as the means of attachment of the hooks as 112, 111 and 110 of the hook panel to the pile assembly.

The largest and larger members of each loop assembly as 243 and 244 in FIG. 22 and 235 and 236 in FIGS. 17 and 18 extend for a greater distance from the surface of the loop panel base layer 171 than the hooks as 202–212 extend from the hook panel base layer 101, as shown in FIGS. 16, 18, 20 and 21; hence those longest loop members of the pile layer 172 in the engaged position of panels 100 and 170, as shown in FIGS. 18, 19, 22 and 23, press against the base layer 101 of the hook panel 100 and thereby more firmly cause a locking engagement between the hook members, as 102 and the loop members as 238 with which engaged as shown in FIG. 18 (and hook members as 112 and the loop members as 241 as shown in FIG. 22).

As shown in FIG. 16 the distance (4.0 mm.) between yarns 151 and 131 above the center of which hooks as 102 and 108 are attached is different from the distances or single multiple of distances between yarns as 196 and 182 (which is same as distance from yarn 191 to 200) of loop pile layer 172 above which yarns are loops engaged by those hooks.

As shown in FIG. 20 each distance between yarns as 113 and 133 and 153 to which hooks as 112 and 111 and 110 are attached abreast of each other respectively is 15 mm. which is different from and greater than the distance of single multiple of distances of 0.67 mm. between multifilament loop-forming yarns as 173, 194 and 199 to which loops (as 241–244 and 251–254 and 261–264) are attached and with which loops those hooks are engaged as shown in FIGS. 22 and 23.

FIGS. 16, 17, 18, 20, 21 and 22 are drawn to the same scale to illustrate the quantitative relations between the hooks of fabric panel 100 and the loops of pile panel portions as 170.

As measured along the section plane shown in FIGS. 16–18 (a) the distance between each of the hook panel warp yarns, as 151 and 131 in each hook panel portion as 100 [adjacent to each of which warp yarns a hook as 102 and 108 is attached] is different from (b) the distance between the pile panel warp yarns of loop pile layer 172 as between warp yarns 201 and 191 (which is same as from yarn 182 to 196) above which pile warp yarns are the loops as 238 engaged by those hooks.

As measured along the plane shown in FIGS. 20, 21 and 22 (a) each distance between the filler yarns as 113 and 133 and 153 from which hooks as 112 and 111 and 110 are formed and which are attached thereto respectively in the hook layer 100 is different from (b) the distances between multifilament loop forming filler yarns as 173, 183, 194 and 199 in the pile layer 171 to which loops (as 241–244 and 251–254 and 261–264) are attached and with which loops those hooks as 110 and 111 and 112 are engaged as shown in FIGS. 22 and 23.

Also the 1.5 m. distances along fabric 101 yarn 120 between centers of loops forming hooks as measured in the section plane shown in FIG. 20 is different from 0.45 m. distances along fabric 171 between centers of loops and small multiples of such distances between loops in directon of plane shown in FIG. 17; and the 4.0 m. distances between hooks along fabric portion 101 as measured in section plane shown in FIG. 16 is different from the 0.67 mm. distances between centers of loops in direction of plane shown in FIG. 21 parallel to yarn 194.

Accordingly, as shown in FIGS. 19 and 23 the central longitudinal axes as 291–294 or length of the loop as 102, 133.3, 133.5, 133.6 forming the hooks of the hook layer 100 are at angles other than right angles to the plane of the pile fabric layer 171 of the pile layer 170 to which attached, such attachment being effected by the pile loops (as 241, 251, 261, 238, 257, 267) of pile or loop layer 172 and the hooks of the hook layer 169 (such as hooks 102, 108, 133.3, 133.4, 133.5, 133.6 in FIG. 19 and 164, 163, 110, 111, 112, 104, 162, 161 in FIG. 23 and as shown also in FIGS. 18 and 22).

As shown in FIGS. 18, 19, 22 and 23 the attachment of each portion of the pile panel fabric layer 171 [and fabric 70 portion therebelow and attached thereto] which is joined to the hook panel portion fabric or base layer 101 [and thereby to pocket wall as 41.1] is effected by a series of non-parallel spaced apart resilient tension bearing combinations composed of mechanically engaged hooks as 102 (FIG. 18) and 112 (FIG. 22) with loops as 238 and 241 respectively while adjacent parts of such portions of pile and hook fabrics as 171 and 101 are resiliently pressed apart between neighboring tension bearing combinations of mechanically joined hooks and loop elements as (a) 102 and 183.8 and (b) 108 and 183.4 (in FIG. 18) by compressed loops as 245 and parts of loop assemblies as 183.2 (FIG. 19). Such fabric portions are also pressed apart by the loop portions as 235 and 244 of loop assemblies (as 183.3 and 173.1) peripheral to the loop portions which are mechanically engaged by the hooks (as 102 and 112).

In this joined structure as shown in FIGS. 18, 19, 22 and 23 substantially all portions of the surface of the base pile layer 171 and all neighboring portions of the base hook layer 101 are located firmly equidistant from each other as measured transverse to the facing surface of neighboring portions of the base pile layer and base hook layer, such portions being of a surface area corresponding to the surface area on the hook base surface being (a) at least as long as the distance from one hook member as 102 to a hook member as 108 formed from the same monofilament as 143 and (b) at least as wide as the distance between two parallel monofilament fibers, as 123 and 143, forming hooks 102 and 103.

According, along the planes shown in FIGS. 18, 19, 22 and 23 the base or fabric layers 101 and 171 are resiliently yet firmly mechanically held and locked in a two dimensionally stable spatial relationship to each other. However, as additionally, (a) the hooks as 102–112 are, as shown in FIGS. 16 and 20, substantially uniformly spaced apart or distributed in planes perpendicular to each other as 16A and 20A over all of the two dimensional surface of hook fabric portions 101 directly supporting and attached to such hooks, as shown in FIG. 14 and (b) the loop assemblies as 183.3–183.8 and 173.1, 183.1 and 193.1 are substantially uniformly spaced or distributed along perpendicular planes 17A and 21A over the two dimensional surface of pile fabric base portion 171 supporting and attached to such loops, as shown in FIGS. 17 and 20 and (c) the spacing of the distribution of the hooks along mutually perpendicular planes 16A and 19A is different from the spacing of the loops in mutually perpendicular planes as 17A and 20A, therefore, (d) each of the base fabric portions 101 and 171 joined to each other as in FIGS. 1, 2, 3, 18, 19, 21, 22 and 23 are firmly held spaced apart yet in a three dimensionally stable spatial relationship by such non-parallel tension members and intermediate compression members.

The resulting three dimensional stiffening effect by such joinder of such panel portions is obtained even if the pile portion base or fabric layer 171 is curved to the contour of the human figure, in which case the resulting stiffened structure composed of panel portions as 100 and 170 will have the curved contour of the curved panel 170, as shown in FIGS. 24 and 25. Such function of creating a contour matching stiffened panel is not achieved by conventional fastening means (as buttons and snaps). The structure of FIGS. 1–23 provide that the fabric 70 and panels 71–75 flexibly match the contour of the wearer's figure when the pocket (or pockets) as 41–43 are detached therefrom. Further still, this connecting and contour matching and maintaining connection structure of panels 100 and 170 above described maintains substantially empty and otherwise frequently collapsed closed pockets of flexible cloth, as 70, in readily located and manipulated condition for access to the interior thereof.

With hooks and loops of size above set out the panel 100 should have minimum height (along edge 41.92) of $1\frac{1}{4}$ inch (3.2 mm.) and a minimum length (as along edge 41.93 of FIG. 8) of 3 inches (7.5 mm.).

In the particular embodiment 30 each of the panels 71–75 are $1\frac{3}{4}$ inches wide and the vest is 25 inches wide (in FIG. 2) and $25\frac{1}{2}$ inches from top of panel 35 to the bottom fold 40. Other dimensions may be found from FIGS. 2 and 5 which are drawn to scale. In panel 170 base layer 171 is 0.4 mm. thick and the total thickness of panel 170 from surface 300 to bottom (as shown in FIG. 21) is 3.0 mm. Panel 100 is 1.9 mm. total thickness from one side (top as shown in FIG. 20) of base layer 101 to the surface 200 and base layer 101 is 0.4 mm. thick. Each of multifilament loop forming fibers as 173, 183, 193 has 8 to 10 fibers each 0.05 mm. diameter.

Each of the loop panels, as 170, and each of the hook panels as 100 is flexible and resilient and can be bent between human fingers readily as shown in FIG. 6 with a radius of curvature 270 of only 1/16 inch. As shown in FIG. 7 a force 271 of only $\frac{3}{4}$ once is required for such bending for a $1\frac{1}{2}$ inch wide piece of panel 170 or 100. However joining a combination of panels 100 and 170 each 1 inch wide and 2 inches long as in FIG. 10 provides a rigid structure capable of bearing 12 ounces of force at 2 inch width (and 6 ounces at 1 inch width) at a distance 274 of 1 inch between a support thereof as fingers 279 and 280 and a scale support plate 276: plate 276 of FIGS. 7 and 10 is a postal scale plate supported on a vertically movable shaft against a spring 278 and provided with a pointer 281 reading on a scale 275 reading in ounces.

When the garment 30 is worn by a human wearer as shown in FIGS. 1, 2, 3 and 24 each of the flexible panel assemblies thereof, as 50 and 60, is shaped or contoured to match the outer surface curvature of the clothing and/or the body of the wearer rather than being flat. Accordingly each of the pile panels 71–75 and 81–85 thereon is shaped or contoured with varied inwardly concave or outwardly convex curvatures and the pile panel outer surfaces have differing radii of curvature or contours along different outer surface lines and outer surface area portions of the panel assemblies 50 and 80 the hook panel portion, as 100 of each pocket as 41, 42 and 43 according to this invention are applied to the exterior surface of the pile fabric as portion 170 of panels 71–75 or 81–85.

On contact of the hooked back panel portions as 100 of each pocket as 41 with the pile panels as 71–75 (or 81–85) such hooked panel acquires the curvature of the pile panels as 71, 72 and 73 therebelow on the curved panel assembly as 50 and matches such curvature. On pressure of the pile panel against the hooked panel by hand the connections between all portions of the pile and hook fabric are effected as diagrammatically shown in FIGS. 18, 19, 22 and 23. Such shaping of the two adjacent panel portions 170 and 100 firmly yet resiliently maintain such curvature of the back panel of the pocket 41 to which such panel portions (100 and 170) are attached as well as forming a rigid shape retaining composite panel member therefor as above described in relation to FIG. 10. In the above description of FIG. 10 a flat structure is shown but the stiffness described by the joinder of the two panel portions 100 and 170 applies also to their joinder when curved as shown in FIG. 25.

The flexibility of the jacket panel peripheral to the pockets, as 41, 42 and 43 is maintained yet those pockets have a rigid dimensionally stable rear panel as 41.1 because of the attachment thereto of the hook panel 100 and the pile panel portion 170 engaged therewith. Such attachment of panels 100, 170 and 41.1 also provides to the back panel 41.1 a stiffened stable shape matching the shape of the curved fabric assembly as 50 or 60 to which attached.

Accordingly, the pockets as 41–43 are not only readily placed at any location on panels 71–75 or 81–85; e.g. at a higher or lower level relative to the bottom edge of the panel assemblies 50 or 80 but also more centrally or more laterally relative to the closure edge 86 but also may be arranged with any such angle slope relative to the horizontal as may be desired (as shown for a pocket 41 which is shown extending horizontally in FIG. 1 and sloped in FIG. 5). Such slope to the horizontal as shown in FIG. 5 and also in FIG. 2 is such as is convenient to the wearer for different purposes; e.g. as a greater engle to the horizontal because of a manner of handling a gun or cigarettes, a forwardly and downwardly sloped top cover is more convenient and desirable than a horizontal one. Additionally, each of the pockets, as 41 and 42 when located on the pile panels of the vest, is placed with the hook panel support member, as 100, thereof engaged with a curved portion of the pile fabric assembly and such curved portion of such hook panel matches the contour of the vest at the area of contact between such hook panel and the pile panel surface therebelow. Accordingly each of such pockets is held more comfortably for the wearer and the weight of material held in that pocket is evenly distributed over the curved portion of the garment. Additional to such comfort due to the contouring effect the pocket, not having a square or flat edges, does not resist body motion or tend to be dislodged on body motion.

For purposes of matching the base contour and maintaining curvature the panels, as 100, should cover substantially all (80 to 100 percent of the area thereof) of the back panel as 41.1 to which attached and all the area of such panel 100 within the outer boundaries of that panel 100 should be substantially and entirely composed of such pile fabric; i.e. no large gaps or holes should be present there: this contrasts with the result obtained only by using strips near the exterior of the panel as 100 of the pocket wall as 41.1 to be supported by such pile fabric portions.

The force required to completely open up a single resilient loop as 109 from the position of its parts shown in full lines in FIG. 12 to the position shown in dotted lines in FIG. 12 is $1\frac{1}{2}$ ounces (42 grams). Each of the separate loops as 238 formed by a loop forming multifilament fiber as 183 is sufficiently strong to support a force of 1 pound (454 grams) applied thereto transverse to base layer 169 before rupture of such loop.

The loop layer 100 may be peeled off the pile layer 170 by pulling successive increments of the relatively flexible pile layer away from the loop layer 100 as by human finger 28 in FIG. 13 in a direction 13B perpendicular to the plane of the hook panel 100 as shown in FIG. 13 while the hook panel is attached to the rear pocket wall as 41.1: the amount of such force on the pile layer as 170 to separate it from the hook panel 100 [of $1\frac{1}{4}$ inches width (3.2 cm.)] in direction perpendicular to the parallel panels 100 and 170 as in FIG. 13 is $1\frac{1}{2}$ pounds (720 grams). However the force withstood along direction 13A of FIG. 13 parallel to the joined flat base layers 101 and 171 where the size of a test sample of hook panel 100 is $1\frac{1}{4}$ inches wide $\times$ 2 inches long and such panel is firmly attached to a longer and wider loop panel sample as 170 (which panels are joined as above described and shown in FIGS. 18, 19, 22 and 23) is in excess of eight pounds (3,600 grams) along the 2 inch dimension of the test panel 100.

A rear closure flap 292 made of the same flexible cloth panels as 70 and 80 has a flexible inner hook panel 293 of the same structure as panel 100 firmly attached thereto and is firmly attached at its top edge to rear panel 38 as shown in FIGS. 3, 4 and 5. A spearately flexible loop panel 294 is firmly attached to the free top edge 295 of the outer rear panel 39: in FIG. 5 the top edge 295 of panel 39 is folded back to show panel 294 and a portion of flap 292 is folded back to shown panel 293. Panels 293 and 294 join as do panels 100 and 170 to provide a contour fitting firm connection between edge 295 and flap 292 that comfortably fits the contour of back of wearer and evenly distributes the weight of the contents of bag 36 across the rear panel 35 and shoulders of the wearer 29. Panel 294 has the same structure as loop panel 170.

I claim:

1. A body contour fitting garment for human wear with detachable pockets comprising;

a. a vertically and horizontally extending flexible back panel with a side and a top edge, b. a vertically and horizontally extending front flexible body fitting panel with a side edge and a top edge, said front and back panels joined at said top edges and said side edges of said panels, said front body fitting panel having a curved contour which matches an adjacent three dimensionally extending curved body contour of a wearer of said garment, c. a vertically and horizontally extending detachable pocket comprising a front wall and a flexible rear wall joined together, d. a horizontally evenly distributed array of a vertically extending evenly distributed series of outwardly curved loops the ends each of which are attached to and extend outward from a surface of a separately flexible loop supporting panel firmly yet flexibly attached to said front body fitting panel and having the same curved contour and said loops are substantially uniformly spaced apart along each of the two different planes perpendicular to each other over said surface of the separately flexible loop supporting panel and said array of loops has an outer surface that is free of palpable protuberances; and e. a horizontally evenly distributed array of vertically extending evenly distributed series of resilient hook members attached to and extending outwardly from a surface of a hook supporting separately flexible panel firmly yet flexibly attached to said rear wall of said pocket and said hooks are substantially uniformly spaced apart along each of two planes perpendicular to each other over said surface of said hook support panel and the spacing of said hook members along said mutually perpendicular planes on the hook support panel is different from the spacing of the loops on the loop support panel along mutually perpendicular planes, f. and the loop supporting panel is joined to said hook supporting panel by a series of non-parallel spaced apart resilient tension bearing combinations of said hook members and said loops in mechanical engagement with each other, and g. adjacent said tension bearing combinations intermediate resilient compression members are compressed between said hook bearing panel and said loop bearing and, adjacent said tension bearing combinations, portions of said pile and hook support panels are resiliently pressed apart between neighboring members of said series of tension bearing combinations of mechanically joined hook members and loops by said resiliently compressed members and substantially all portions of the surfaces of the loop supporting panel and neighboring portions of the hook supporting panel so joined are firmly located equidistant from each other whereby said separately flexible loop bearing panel and said separately flexible hook bearing panels are firmly held spaced apart in a resulting three dimensionally stable stiffened structure having the curved contour of said curved loop support panel.

2. A garment as in claim 1 wherein said rear wall of said pocket and said array of loops each has a height and a width and said rear wall of said pocket has a lesser height and a lesser width than said array of loops.

3. A garment as in claim 1 wherein each of said loop supporting panels is attached to a plurality of pockets and each of said pockets extends at different angles to the horizontal.

4. A garment as in claim 1 comprising loops in said array of loops which extend further from said surface of said loop supporting panel than the loops engaged by said hook members and are resiliently compressed between said hook supporting panel and said loop supporting panel.

5. A garment as in claim 4 and also comprising loops in said array of loops which (a) are more closely spaced than said hook members in said array of hook members and (b) extend further from said loop supporting panel than the loops engaged by said hook members and (c) are resiliently compressed between said hook supporting panel and said loop supporting panel.

6. A garment as in claim 1 comprising loops in said array of loops which (a) are more closely spaced than said hook members in said array of hook members and (b) extend further from said loop supporting panel than the loops engaged by said hook members and (c) are resiliently compressed between said hook supporting panel and said loop supporting panel.

7. A garment as in claim 6 wherein said rear wall of said pocket and said array of loops each has a height and a width and said rear wall of said pocket has a lesser height and a lesser width than said array of loops.

8. A garment as in claim 7 wherein each of said loop supporting panels is attached to a plurality of pockets and each of said pockets extends at different angles to the horizontal.

* * * * *